United States Patent [19]

Teruyama

[11] 4,078,872

[45] Mar. 14, 1978

[54] PRESSURE LOADED GEAR PUMP

[75] Inventor: Hideo Teruyama, Ageo, Japan

[73] Assignee: Kayabakogyokabushikikaisha, Tokyo, Japan

[21] Appl. No.: 732,478

[22] Filed: Oct. 14, 1976

[30] Foreign Application Priority Data

Oct. 17, 1975 Japan ..... 50-125150
May 22, 1976 Japan ..... 51-59453

[51] Int. Cl.[2] ..... F01C 19/08; F03C 3/00; F04C 15/00

[52] U.S. Cl. ..... 418/132

[58] Field of Search ..... 418/131, 132

[56] References Cited

U.S. PATENT DOCUMENTS

| | | | |
|---|---|---|---|
| 2,742,862 | 4/1956 | Banker | 418/132 |
| 2,842,066 | 7/1958 | Hilton | 418/132 |
| 3,539,282 | 11/1970 | Forschner | 418/132 |
| 3,833,319 | 9/1974 | Eglington | 418/132 |
| 3,961,872 | 6/1976 | Muller et al. | 418/132 |

FOREIGN PATENT DOCUMENTS

| | | | |
|---|---|---|---|
| 1,355,957 | 6/1974 | United Kingdom | 418/132 |

*Primary Examiner*—John J. Vrablik
*Attorney, Agent, or Firm*—Saul Jecies

[57] ABSTRACT

Disclosed is a pressure loaded gear pump wherein two assemblies each consisting of a pair of abutted bushings are axially slidably fitted into a casing on both sides of a pair of intermeshing impeller gears for supporting rotatably the shafts thereof and for sealing the side faces of the gears; and defined on each side of the casing between the pair of abutted bushings and an end plate are a low pressure chamber into which is admitted the hydraulic pressure in a suction opening, a high pressure chamber into which is admitted the hydraulic pressure in a discharge opening and two moderate pressure chambers each of which is communicated with a sector between the suction opening and the pressure transition or gradient sector of the liquid passage from the suction to discharge openings. The effective area of each moderate pressure chamber is equal to or slightly greater than the cross sectional area of the space between the teeth of the gears. Under the pressures acting on the bushings in the high, moderate and low pressure chambers, the bushings are optimumly pressed against the side faces of the impeller gears independently of the rotational speed and the temperature of liquid being handled, whereby the very effective sealing may be attained and not only the generation of operational noise but also wear of rubbing surfaces of the bushings and gears may be minimized.

5 Claims, 6 Drawing Figures

PRESSURE LOADED GEAR PUMP

BACKGROUND OF THE INVENTION

The present invention relates to a fixed displacement gear pump of the type including seal bushings upon the outer ends of which act the pressures, and more particularly an improvement of hydraulic sealing arrangement wherein the side faces of a pair of intermeshing impeller gears are sealed by the bushings which rotatably support the shafts of the gears.

In the gear pumps of the type described above, the shafts of the intermeshing impeller gears are supported rotatably by the bushings which in turn are axially slidably fitted into the casing, and defined between the outer ends of the bushings on each side of the casing and an end plate are a low pressure chamber into which is admitted the low pressure at the suction opening and a high pressure chamber into which is admitted the high pressure at the discharge opening. In operation the high and low pressures act on the outer ends of the bushings to counteract the hydraulic pressures acting on the inner ends of the bushings in contact with the side faces of the gears so that the inner ends may be optimumly pressed against the side faces of the gears for hydraulic sealing.

As is very well known in the art, as the spaces between the teeth of the gears pass the suction opening, liquid is impounded in the spaces between the teeth, carried along the casing to the discharge opening and then forced through this opening. The passage of liquid through the gear pump may be divided into a low pressure sector in communication with the suction opening, a pressure transition sector wherein the pressure is gradually increased and a high pressure sector wherein the pressure is equal to the pressure in the discharge opening because the spaces between the teeth of the gears are communicated with the discharge opening through a clearance produced between the outer ends of the teeth and the casing when the gears are pressed toward the suction opening because of the pressure difference between the suction and discharge openings. The hydraulic pressure in the pressure transition sector changes over a wide range depending upon operational factors such as rotational speed of the gear pump, the temperature of liquid being pumped and so on so that the loading forces acting on the bushings for pressing them against the side faces of the gears are unbalanced and consequently operational noise is produced. In the worst case, the seizure of bushings occurs, resulting in serious damage.

In order to overcome these problems, there has been proposed a countermeasure wherein speed slots are provided to intercommunicate between the high pressure sector and the spaces between the teeth of the gears passing through a part of the pressure transition sector so that the pressure in the part of the transition sector may be substantially equal to the pressure in the high pressure sector. Furthermore, a second high pressure chamber or moderate pressure chamber is defined between the outer end of the bushing and the end plate at the position corresponding to a part of the pressure transition sector adjacent to the low pressure sector, and is communicated with the space between the teeth of the gear passing the transition zone adjacent to the low pressure sector.

By this arrangement, the bushings may be pressed against the side faces of the gears under almost uniform loading forces independently of the rotational speed of the gear pump and the temperature of liquid being handled, but there arises the problem that the speed slots cause errosion so that the service life of the gear pump is considerably reduced. The only solution to this problem is the elimination of speed slots. However, if speed slots are eliminated, the desired loading pressures act on the bushings only when the gear pump is driven at a speed within a limited range. At high or low speeds the loading forces are unbalanced so that leakages are increased with the resultant decrease in volumetric efficiency and excessive wear of rubbing surfaces of the bushings and gears occurs. It is considered that the unbalanced loading forces are caused by the improper selection of the area of the second high pressure or moderate pressure chamber.

So far O-rings have been used for defining the second high or moderate pressure chambers so that it is difficult to define a moderate pressure chamber having a sufficient area. Therefore the loading force in the moderate pressure chamber cannot follow the change in pressure in the transition sector when the gear pump is driven at high or low speeds so that the loading forces are unbalanced. Some attempts have been made to define the moderate pressure chambers without the use of O-rings, but so far they have not been successful in practice because parts are complex in construction, the steps for machining and assembly are increased in number and consequently the cost is increased.

SUMMARY OF THE INVENTION

In view of the above, one of the objects of the present invention is to provide an improved sealing arrangement for pressure-loaded gear pumps which may effect the pressure-loaded seal of the side faces of the impeller gears in a very simple and economical manner hitherto unattained by the prior art.

The present invention ensures the attainment of the optimum loading forces acting on the bushings and of the best efficiencies of the gear pump. One of the features of the present invention lies in that the loading forces may be well balanced over the whole range of speeds independently of the temperature of liquid being handled by the effective increase in area of the second high or moderate pressure chamber without the use of speed slots.

According to one preferred embodiment of the present invention, the shafts of the impeller gears are rotatably supported by the bushings which have the inner bushings force-fitted therein and are axially slidably fitted into the casing. Each bushing has its inner end pressed against the side face of the gear and outer end formed with an axially raised land. This land covers the suction opening which is maintained at a relatively low pressure level during operation, a part of the pressure transition sector adjacent to the suction opening and the area adjacent to the shaft of the gear. Furthermore the land is surrounded with or bounded by an O-ring to define a low pressure chamber into which is admitted the hydraulic pressure at the suction opening. An O-ring which is fitted in a recess formed in the end face of the casing cooperates with the O-ring surrounding the low pressure chamber to define a high pressure chamber which surrounds the low pressure chamber and into which is admitted the hydraulic pressure in the discharge opening.

Within the low pressure chamber, recesses are formed in the lands at the positions corresponding to the pressure transition sectors for defining moderate pressure chambers. Each recess is contiguous to the outer surface of the inner bushing fitted into the bushing so that a part of the outer surface of the inner bushing defines one side wall of the moderate pressure chamber. The recess is communicated with the space between the teeth of the gear passing the pressure transition sector, and a sealing member is fitted into the recess, whereby the moderate pressure chamber into which is admitted the pressure in the pressure transition sector may be defined within the low pressure chamber.

Since the moderate pressure chamber is contiguous to the outer surface of the inner bushing, the effective area of the moderate pressure chamber may be made equal to or slightly greater than the cross sectional area of the space between the teeth of the gear. As a result, the optimum loading forces may be exerted on the bushings over the whole operation range independently of the temperature of liquid being handled without the use of speed slots. As compared with the prior art which teaches the provision of the second high or moderate pressure chamber in the end plate, the fabrication may be much facilitated because the moderate pressure chamber is formed in the outer end of the bushing which has a substantial thickness. Moreover the moderate pressure chamber is hydraulically sealed from the low pressure chamber with the sealing member which is so arranged as to exert no axial force to the bushing so that the loading force acting on the bushing in the moderate pressure chamber is dependent only upon the pressure in the pressure transition sector and consequently the optimum balance between the loading forces may be attained.

The above and other objects, features and advantages of the present invention will become more apparent from the following description of a preferred embodiment thereof taken in conjunction with the accompanying drawings.

BRIEF DESCRIPTION OF THE DRAWINGS

Same reference numerals are used to designate similar parts throughout figures.

DESCRIPTION OF THE PREFERRED EMBODIMENT

Figure 1:
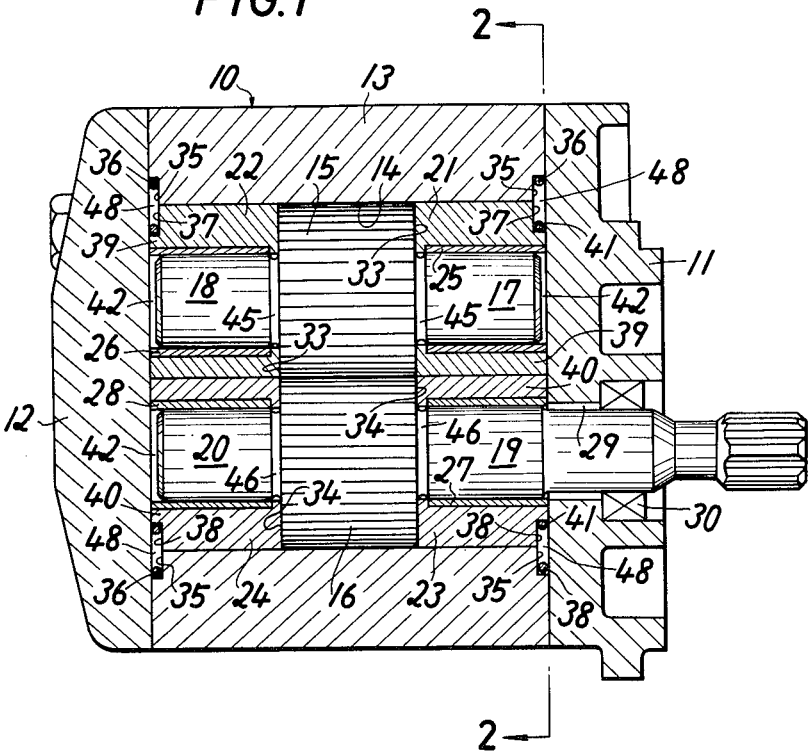
FIG. 1 is a longitudinal sectional view of a gear pump in accordance with the present invention.

Referring to FIG. 1, a gear pump 10 in accordance with the present invention has a casing 13 with cover or end plates 11 and 12, and a pair of intermeshing impeller gears 15 and 16 rotate in a bore 14 of the casing 13 with extremely small clearance between each other and between the rubbing surfaces of the gears 15 and 16 and the bore wall. The gear 15 has shafts 17 and 18 while the gear 16 has shafts 19 and 20. These shafts 17, 18, 19 and 20 are rotatably fitted into bushings 21, 22, 23 and 24, respectively, which in turn are axially slidably fitted in the bore 14. The bushings 21, 22, 23 and 24 are made of metal such as an aluminum alloy and have inner bushings 25, 26, 27 and 28, respectively, lined with steel and force fitted into the bushings 21 through 24.

The shaft 19 of the gear 16 is extended through a shaft hole 29 of the end plate 11 for driving connection with a prime mover (not shown) exterior of the gear pump 10. The shaft 19 is sealed with an oil seal 30 fitted in the shaft hole 29. As indicated by the broken lines in FIG. 2, a suction opening 31 and a discharge opening 32 are formed in the casing 13 and communicated with the bore 14.

Upon rotation of the shaft 19 by the prime mover, the gear 16 drives the gear 15. As the spaces between the teeth of the gears 15 and 16 pass the suction opening 31, liquid is impounded between them, carried around the casing to the discharge opening 32, and then forced through this opening. The arrows indicate the flow of liquid. When the pressure builds up in the opening 32, the gears 15 and 16 are forced toward the suction opening 31 so that the teeth of the gears 15 and 16 are moved away from the bore wall on the side of the discharge opening 32 and consequently the pressure of liquid trapped in the spaces between the teeth closer to and in the discharge opening 32 becomes equal to the pressure in the discharge opening 32. On the suction opening side, the teeth of the gears 15 and 16 are firmly pressed against the casing 13 so that the leakage to the suction opening 31 through the space between the teeth of the gears 15 and 16 and the casing may be prevented. Therefore the passage between the suction and discharge openings 31 and 32 may be divided into a first sector (to be referred to as "pressure transition sector") where the pressure of liquid trapped in the spaces between the teeth of the gears 15 and 16 is gradually increased and a second or high pressure sector where the pressure is equal to the pressure in the discharge opening 32. The intermeshed teeth of the gears 15 and 16 prevent the leakage of liquid from the discharge opening 32 to the suction opening 31, whereby the decrease in pump efficiency may be prevented.

During operation, the pressure is exerted to the outer ends of the bushings 21 through 24 which are axially slidably disposed in the bore 14 so that the inner ends of the bushings 24 through 24 are pressed against the side faces 33 and 34 of the gears 15 and 16 to seal them. The pressure exerting on the outer ends of the bushings 21 through 24 (this pressure being referred to as "the loading pressure" in this specification) is maintained at an optimum level for sealing the side faces of the gears in the manner to be described below.

Figure 2:
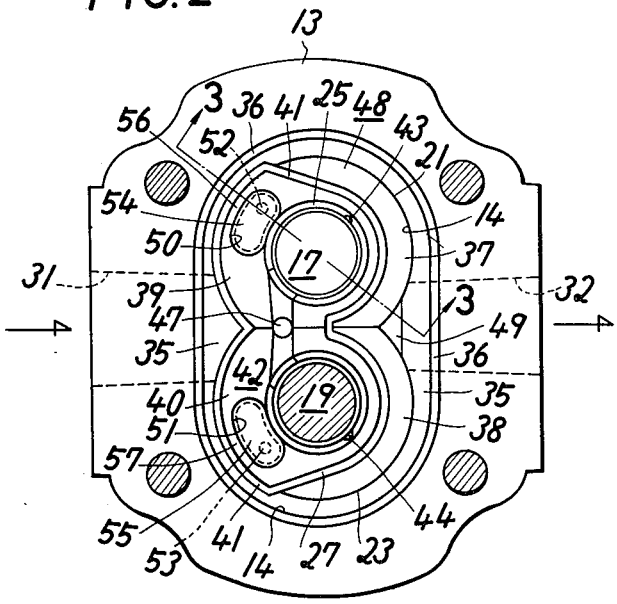
FIG. 2 is a cross sectional view thereof taken along the line 2—2 of FIG. 1.

As shown in FIGS. 1 and 2, recesses 35 contiguous to the bore 14 are formed in the end faces of the casing 13, and an outer O-ring 36 is fitted into each recess 35 in contact with the wall thereof for sealing the recess 35 in cooperation with the end plate 11 or 12.

The bushings 21 through 24 are axially slidably and very closely fitted into the casing 13. In the present embodiment, the bushings 21 through 24 have a D-shaped cross section, and the flat surfaces of the bushings 21 and 23 and of the bushings 22 and 24 are abutted against each other when assembled and fitted into the bore 14 of the casing 13. However, the bushings 21 and 23 or 22 and 24 may be integral. The bushings 21 and 24 are substantially similar in construction, and so are the bushings 22 and 23. The bushings 21 and 22 and the bushings 23 and 24 and symmetrical so that when the bushings 21 through 24 are assembled and fitted into the casing 13 as shown in FIG. 1, the right assembly of the bushings 21 and 23 and the left assembly of the bushings 22 and 24 are substantially similar in construction to each other except that they are directed in opposite directions. Therefore the present invention will be described only with reference to the right assembly of the bushings 21 and 23, and the construction and function of the left assembly will be obvious from the description of the right assembly.

The outer ends of the bushings 21 and 23 are formed with recesses 37 and 38, which mate with the recess 35, and with lands 39 and 40 substantially in coplanar with the end face of the casing 13. An inner O-ring 41 is fitted around the periphery of the lands 39 and 40 to seal a low pressure chamber 42 defined between the lands 39 and 40 and the end plate 11. This chamber 42 is hydraulically communicated with the suction opening 31 through axial grooves 43 and 44 formed in the inner bushings 25 and 27 and annular grooves 45 and 46 at the roots of the shafts 17 and 19 of the gears 15 and 16. The pressure in the chamber 42 is therefore equal to the pressure in the suction opening 31 during operation, and acts on the bushings 21 and 23 so that the latter may be pressed against the side faces 33 and 34 of the gears 15 and 16 with the optimum loading force. The configurations of the lands 39 and 40; that is, the configuration of the low pressure chamber 42 are so designed that the chamber 42 is eccentric relative to the axes of the shafts 17 and 19, whereby the portions of the inner ends of the bushings 21 and 23 which are exerted with the low hydraulic pressure in the chamber 42 may optimumly seal the side faces 33 and 34 of the gears 15 and 16 not only in the suction opening 31 but also in the pressure transition sector where the hydraulic pressure varies depending upon the rotational speed of the gear pump 10 and the temperature if liquid being pumped. The liquid admitted into the chamber 42 from the suction opening 31 through the annular grooves 45 and 46 at the roots of the shafts 17 and 19 and the axial grooves 43 and 44 of the inner bushings 25 and 27 is returned to the suction opening through a return or drain passage 47 defined by grooves formed in the abutting flat surfaces of the bushings 21 and 23. Therefore the circulating liquid also serves to lubricate and cool the rubbing surfaces of the inner bushings 17 and 19 and the shafts 17 and 19.

Meanwhile, the inner and outer O-rings 41 and 36 define a high pressure chamber 48 surrounding the low pressure chamber 42. More particularly, the high pressure chamber 48 is defined by the recess 35 of the casing 13 and recesses 37 and 38 of the bushings 21 and 23 and the end plate 11, and is communicated with the discharge opening 32 through a communication passage 49 formed in the bore wall of the casing 13 so that the high hydraulic pressure acts as the loading pressure on the outer ends of the bushings 21 and 23 in the high pressure chamber 48. Therefore the inner ends of the bushings 21 and 23 may seal under a high pressure the side faces 33 and 34 of the gear 15 and 16 in the pressure transition sector adjacent to the high pressure sector and the high pressure sector including the discharge opening 32.

Figure 3:
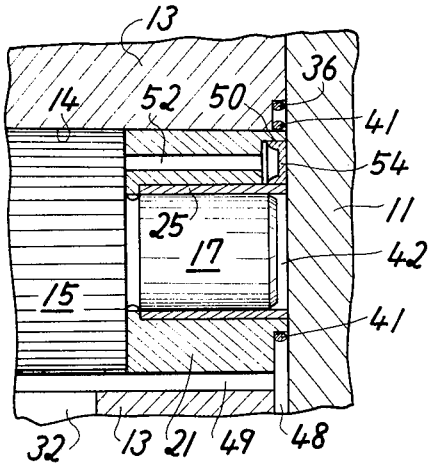
FIG. 3 is a sectional view thereof taken along the line 3—3 of FIG. 2.
Figure 4:
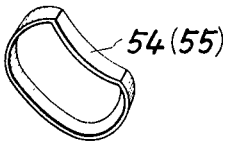
FIG. 4 is a perspective view illustrating a sealing member used for sealing the moderate pressure chamber.

According to the present invention, recesses 50 and 51 are formed in the lands 39 and 40 of the bushings 21 and 23 at the places each corresponding to a transition sector between the low pressure sector or suction opening 31 and the pressure transition sector. The inner side of each recess 50 or 51 is opened and contiguous to the outer surface of the inner bushing 25 or 27 fitted into the outer bushing 21 or 23 as best shown in FIG. 3. In other words, the outer surface of the inner bushing 25 or 27 defines the inner wall of the recess 50 or 51. The recesses 50 and 51 are communicated with the spaces between the teeth in the pressure transition sector of the gears 15 and 16 through passages 52 and 53 axially drilled through the bushings 21 and 23, and a cup-shaped sealing member 54 or 55 as best shown in FIG. 4 is fitted into the recess 50 and 51 as shown in FIG. 3, whereby a second high pressure or moderate presure chamber may be defined. The moderate pressure transmitted from the pressure transition sector exerts the loading force to the bushing 21 or 23 in the moderate pressure chamber 50 or 51.

As described previously, the pressure in the pressure transition sector changes over a considerably wide range depending upon various operational factors such as the rotational speed, the temperature of liquid being handled and so on so that the efficient operation of the gear pump 10 is limited within a certain range of rotational speed. At high or low speeds, the loading forces are unbalanced so that the leakage from the discharge opening to the suction opening is increased with the resultant decrease in volumetric efficiency and increase in wear of the rubbing surfaces of the bushings 21 and 23 and the side faces 33 and 34 of the gears 15 and 16.

The effective area of the recess 50 or 51 may be selected equal to or slightly greater than the cross sectional area of the space between the teeth of the gear 15 or 16 so that the loading force in the moderate pressure chamber 50 or 51 may smoothly follow the change in pressure in the pressure transition sector. As a result, the optimum loading force may be obtained independently of the rotational speed and the temperature of liquid being handled.

The pressure difference in the high and moderate pressure chambers 48 and 50 or 51 is relatively smaller so that the wall 56 or 57 between them may be reduced in thickness without causing any adverse effects on mechanical strength. This means that the effective area of the moderate pressure chamber 50 or 51 may be increased in a limited space.

Since the moderate pressure chambers 50 and 51 are located on the outer ends of the bushings 21 and 23, they may be formed relatively easily. Furthermore, no force is exerted from the sealing member 54 or 55 to the bushing 21 or 23 so that the loading force in the moderate pressure chamber 50 or 51 is produced only by the hydraulic pressure in the pressure transient sector. Therefore the optimum balance between the loading forces may be attained.

During the operation, the right and left assemblies of the bushings 21 through 24 are well balanced and optimumly seal the side faces 33 and 34 of the gears 15 and 16 with the loading forces admitted into the low, moderate and high pressure chambers in the manner described above.

Figure 5:
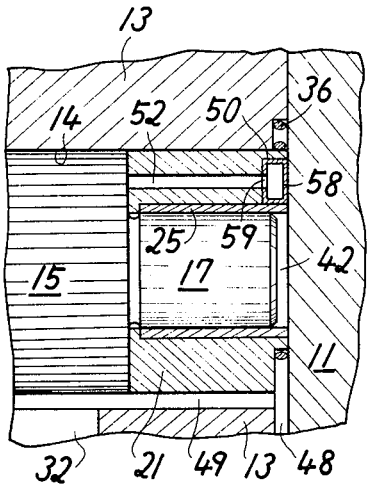
FIGS. 5 and 6 are views similar to FIG. 3 but illustrating different sealing members, respectively, for the moderate pressure chamber.

Instead of the cup-shaped sealing member 54 or 55 shown in FIG. 4, a box-shaped sealing member 58 as shown in FIG. 5 may be used and communicated with the passage 52 through an opening 59. In this case, in order to attain better sealing effects it is preferable to expand the inner wall slightly outwardly so that when the end plate 11 is attached to the casing 13, the inner wall exerts small force to the bushing 21 in the axial direction thereof.

Figure 6:
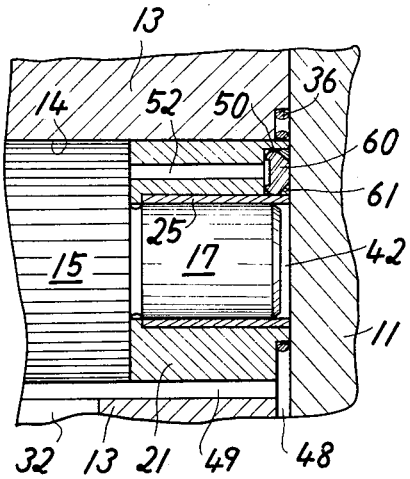

With the sealing member 54 or 58, the moderate pressure chamber or recess 50 or 51 is substantially filled with air when assembled. Therefore when the pressure in the moderate pressure chamber 50 or 51 very frequently changes in response to the pressure change in the pressure transition sector during operation, heat is generated, resulting in the shorter service life of the sealing member 50 or 58. To overcome this problem, as shown in FIG. 6, a plenum counterbalancing seal 60 substantially trapezoid in cross section may be used together with backup seals 61, whereby the volume of the moderate pressure chamber 50 or 51 may be reduced.

So far the present invention has been described with reference to the preferred embodiment thereof, but it will be understood that the present invention is not limited thereto. For instance, instead of exerting the loading forces to both side faces of the gears, the loading forces may be applied only to one side faces of the gears. Therefore it will be understood that variations and modifications can be effected within the spirit and scope of the present invention as described hereinbefore and as defined in the appended claims.

What is claimed is:

1. A gear pump, comprising a casing with an impeller gear bore;

a suction opening and a discharge opening both of which communicate with said bore;

a pair of intermeshing impeller gears disposed for rotation in said bore and having respective axial end faces and circumferential teeth which define a low-pressure sector communicating with said suction opening, a high-pressure sector communicating with said discharge opening and a pressure transition sector between said low and high-pressure sectors;

bushings having axial holes with inner bushings therein for rotatably supporting the shafts of said gears, said bushings being disposed in said bore adjacent the respective end faces for axial movement relative to the same;

a low-pressure chamber defined on each side of the casing by the outer ends of the bushings remote from said end faces, an end plate of said casing and an O-ring which defines the outer periphery of said low-pressure chamber, said low pressure chamber being hydraulically communicated with said suction opening to admit therein the hydraulic pressure prevailing in said suction opening so that the portion of the inner ends of said bushings corresponding to said low-pressure chamber sealingly engages the end faces of said gears in said suction opening and over part of said pressure transition sector in the proximity of the shafts of said gears;

a high-pressure chamber surrounding said low-pressure chamber and defined on each side of the casing by the outer ends of said bushings, said end plate, said casing and an O-ring which defines the outer periphery of said high-pressure chamber, said high-pressure chamber being hydraulically communicated with said discharge opening to admit the hydraulic pressure thereat into said high-pressure chamber so that the hydraulic pressure in said high-pressure chamber exerts a loading force upon said bushings, whereby the portion of the inner ends thereof corresponding to said high-pressure chamber sealingly engages the end faces of said gears over the remaining part of said pressure transition sector and the discharge opening; and a moderate-pressure chamber defined in the outer end of each of said bushings within said low-pressure chamber and communicated with the space between the teeth of the gear in said pressure transition sector, said moderate-pressure chamber being defined by a recess formed in the outer end of the respective bushing and opened to the axial hole of said bushing, the outer surface of an inner bushing fitted in said axial hole and which outer surface forms a wall of said recess at the opened side thereof, and a sealing member fitted into said recess for sealing said moderate-pressure chamber from said low-pressure chamber, the effective area of said moderate-pressure chamber being at least equal to the cross-sectional area of the space between two adjacent teeth of the meshing gears.

2. A gear pump as set forth in claim 1, wherein said sealing member for said moderate-pressure chamber is a cup-shaped seal.

3. A gear pump as set forth in claim 1, wherein said sealing member for said moderate-pressure chamber is a box-shaped hollow seal having an opening formed through one side wall for communication with said spaces between the teeth of the gear.

4. A gear pump as set forth in claim 1, wherein said sealing member for said moderate-pressure chamber substantially fills the same and is provided with a very shallow recess formed at a bottom thereof.

5. A gear pump as set forth in claim 4, wherein a backup seal is fitted over said counterbalance sealing member adjacent to a top surface thereof.

* * * * *